US008371873B2

(12) United States Patent
Rizzo

(10) Patent No.: US 8,371,873 B2
(45) Date of Patent: Feb. 12, 2013

(54) ILLUMINATED ELECTRICAL CONNECTOR

(75) Inventor: Gilberto Rizzo, Cusano Milanino (IT)

(73) Assignee: Woodhead Industries, Inc., Lincolnshire, IL (US)

( * ) Notice: Subject to any disclaimer, the term of this patent is extended or adjusted under 35 U.S.C. 154(b) by 0 days.

(21) Appl. No.: 13/139,419

(22) PCT Filed: Dec. 12, 2008

(86) PCT No.: PCT/US2008/086634

§ 371 (c)(1),
(2), (4) Date: Aug. 26, 2011

(87) PCT Pub. No.: WO2010/068220

PCT Pub. Date: Jun. 17, 2010

(65) Prior Publication Data

US 2011/0300743 A1 Dec. 8, 2011

(51) Int. Cl.
*H01R 3/00* (2006.01)

(52) U.S. Cl. ..... 439/490

(58) Field of Classification Search ..... 439/490, 439/491, 488, 76.1, 620.21, 620.22, 620.24, 439/620.25

See application file for complete search history.

(56) References Cited

U.S. PATENT DOCUMENTS

| | | | | |
|---|---|---|---|---|
| 5,567,175 | A * | 10/1996 | Warden et al. | 439/490 |
| 6,053,765 | A | 4/2000 | Eakins | |
| 6,078,113 | A | 6/2000 | True et al. | |
| 6,490,163 | B1 * | 12/2002 | Pua et al. | 439/165 |
| 6,733,333 | B1 | 5/2004 | Chen | |
| 7,540,773 | B2 * | 6/2009 | Ko | 439/581 |
| D622,216 | S * | 8/2010 | Rizzo | D13/133 |
| 2005/0099812 | A1 | 5/2005 | Lee | |
| 2005/0101180 | A1 | 5/2005 | Sirichai et al. | |
| 2009/0023329 | A1 * | 1/2009 | Mehnert et al. | 439/490 |
| 2009/0305521 | A1 * | 12/2009 | Yang et al. | 439/56 |

FOREIGN PATENT DOCUMENTS

| | | | |
|---|---|---|---|
| DE | 203 03 478 | U1 | 5/2003 |
| WO | WO 00/26997 | A1 | 5/2000 |

OTHER PUBLICATIONS

International Search Report for PCT/US2008/086634.

* cited by examiner

*Primary Examiner* — Felix O Figueroa
(74) *Attorney, Agent, or Firm* — Larry I. Golden

(57) ABSTRACT

An illuminated or self-illuminating electrical connector is provided that has an internal light source with, electrical circuitry for illuminating the light source. The housing arrangement of the illuminated electrical connector is such that light emanating from the light source is visible through the housing arrangement to the extent that the light is visible through greater than half of the external surface of the illuminated electrical connector. Also visible through the housing arrangement, when the light source is illuminated, is an electronic component that provides an aesthetic and 'high-tech' enhancement to the illuminated electrical connector.

16 Claims, 6 Drawing Sheets

ILLUMINATED ELECTRICAL CONNECTOR

BACKGROUND OF THE INVENTION

The present invention generally relates to electrical connectors that exhibit illumination when in use. More particularly, the invention relates to self-illuminating electrical connectors that have internally originating illumination that provides an illumination condition visible through connector housing walls throughout a majority of or substantially the entirety of the electrical connector.

The current state of the art for illuminated electrical connectors includes cube-shaped connectors, including connectors for valves for controlling pneumatic, hydraulic and general industrial control systems. Other applications for connectors having self-contained illumination are contemplated for use in those instances where self-illumination will provide easy visualization that assists in the connection tasks and indicates when disconnection, disruption or failure has occurred. Other benefits of self-illuminating connectors include providing enhanced illumination around the connector during an un-mating operation in order to provide enhanced safety during such disconnection due to the ability of the technician to better see the connector and components such as plugs, pins, terminals, boards and the like that mate with complementary locations or components of the connector. A self-illuminating connector also provides enhanced visibility for diagnostic purposes by enhancing the ability to see that the connector is operating correctly by being illuminated, thereby indicating proper connection to a source that supplies power or energy to and through the connector. When such a connector is not illuminated, the absence of a proper connection is thereby readily ascertained by simple observation.

Self-illuminating connectors that are within the state of the art include those having an opaque housing with a portion that has transparent characteristics to allow passage of light from inside the connector to a location outside of the connector that is of limited area. One such connector has a narrow peripheral band of an otherwise opaque connector housing, which band illuminates upon mating of the connector with a power source.

Another connector includes standard or SMD components within the connector. All or most of these electronic components are within an internal housing that is made of opaque material. This opaque housing is mounted within an outer housing made of transparent or translucent material, and a light source is positioned within the outer housing but outside of the opaque inner housing, with the result that a portion of the connector is illuminated, namely the portion of the outer housing that falls within the path of illumination of the light source and that is not blocked by the opaque inner housing. One such connector is available from Hirschmann, included in the state of the art of valve connectors for pneumatic applications, for example. Other such state-of-the-art valve connectors are those of Molex. Often such state-of-the-art connectors are of a terminal block style. These can take the form of field-attachable DIN (Deutsches Institut für Normung) valve connectors that meet the EN 175301-803 standards for selected applications, including those for pneumatic, hydraulic and general industrial control.

An example of a control valve is found in Rüdle et al., U.S. Pat. No. 6,681,800 (Festo AG & Co.). Other DIN connectors are found in Fulponi et al., U.S. Pat. No. 5,037,330 and Fang U.S. Pat. No. 6,764,338. Other examples of connectors in the state of the art include those that have illumination capabilities. These include Eakins U.S. Pat. No. 6,053,765, Madsen et al. U.S. Pat. No. 6,159,037 and Chang, et al., U.S. Pat. No. 6,319,051. Each of the patents noted herein is incorporated by reference hereinto.

SUMMARY OF THE INVENTION

The present invention includes the discovery and realization that the illumination capabilities and effects are limited by the state-of-the-art approaches. Such realization and discovery is founded in the recognition of enhancements that can be attained by taking illumination attributes to a higher level. This higher level involves substantially increasing the surface area of the outer casing that exhibits illumination while simultaneously allowing an aesthetic enhancement by providing a unique "high-tech" appearance to an otherwise mundane electrical connector. Such enhancements increase the functionality and safety of the connector by providing amore substantial signal of connection and a more robust level of illumination during connection and loss thereof during disconnection, which often occur in dimly illuminated locations, devices, equipment or areas. Furthermore, such enhancements allow one to visualize electronic components positioned within the connector in order to better observe, diagnose and appreciate these components, while placing a premium on well-designed placement of electronic components such as printed circuit boards, contacts, pins, and other electronic components by allowing them to be not only visible but also complimented by selected illumination coloration or colors and/or by light transmitted through surfaces providing coloration.

In an embodiment, an illuminated electrical connector is provided that comprises an internal housing that has positioned fully or partially therewithin electronic components, which internal housing has transparent characteristics that are adequate to permit light to pass therethrough. The internal housing is positioned within an external housing also having transparent characteristics adequate to permit light to pass therethrough. A light source is positioned internal of the internal housing and is associated with an electrical circuit for illuminating the light source, whereby illumination from the light source passes through both the internal housing and the external housing (where an internal housing wall is present between the light source and the external housing) and is visible through at least 50% of the external housing.

In another embodiment, the illuminated electrical connector has an internal housing that supports electronic components and connection components, with this internal housing having transparent characteristics adequate to permit light to pass therethrough, while an external housing surrounds the internal housing and also has transparent characteristics adequate to permit light emanating from the internal housing to pass through the external housing. A light source is positioned internal of the internal housing along with electrical circuitry for illuminating the light source when connected to external power. Illumination from the light source is visible through the external housing at substantially the entirety of the external housing.

According to a further embodiment, an internal housing and an external housing are provided, each having transparent characteristics adequate to permit light emanating from the internal housing to pass therethrough, with the internal housing being one or more components positioned within the external housing, with a light source being internal of the internal housing, the light source being a light emitting diode (LED) that provides illumination, which can be clear or of selected coloration.

According to an additional embodiment, multiple LED light sources are provided within a substantially transparent external or outer housing and/or a substantially transparent internal or inner housing within which electronic components are positioned. Upon illumination, the multiple LED light sources can provide different coloration for either diagnostic or aesthetic enhancement purposes.

Other aspects, features, objects and/or advantages of the invention will be apparent from the following detailed description, taken in conjunction with the accompanying drawings.

DETAILED DESCRIPTION OF THE ILLUSTRATED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner, including employing various features disclosed herein in combinations that might not be explicitly disclosed herein.

An illuminated or self-illuminating electrical connector is generally designated at 21 in various figures, including FIG. 1, FIG. 2, FIG. 3, FIG. 4, FIG. 5, FIG. 6 and FIG. 7. The connector 21 has a housing arrangement that allows light emanating from an internal light source to be visible from the outside of the connector. An external housing 22 is depicted that is of a general block style and that includes a cylindrical branch 23 that is provided for accepting known male components such as the threaded adapter 24 of a type known to those skilled in the art.

Figure 1:
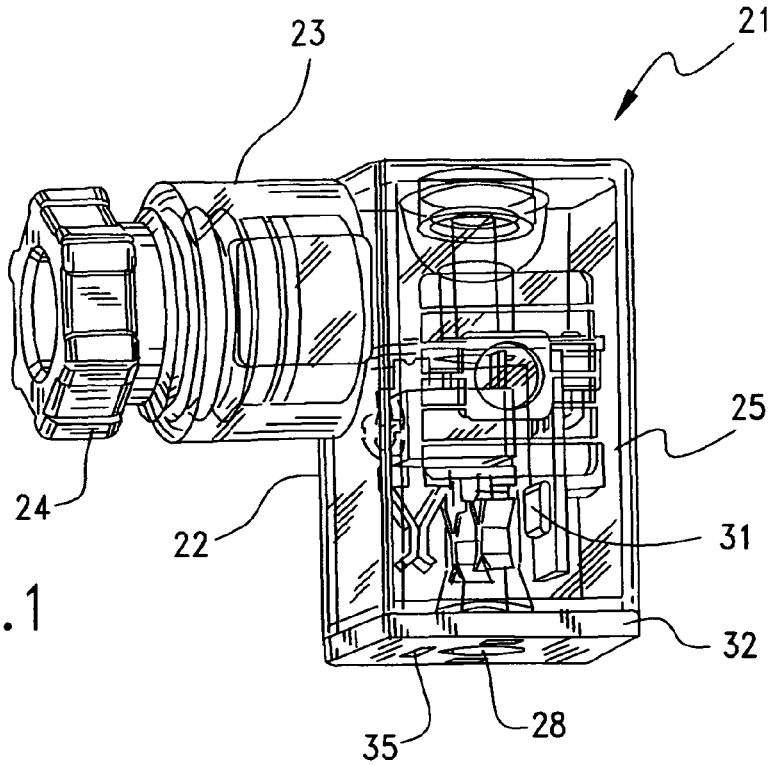
FIG. 1 is a perspective view of an embodiment of an illuminated electrical connector according to the invention.
Figure 2:
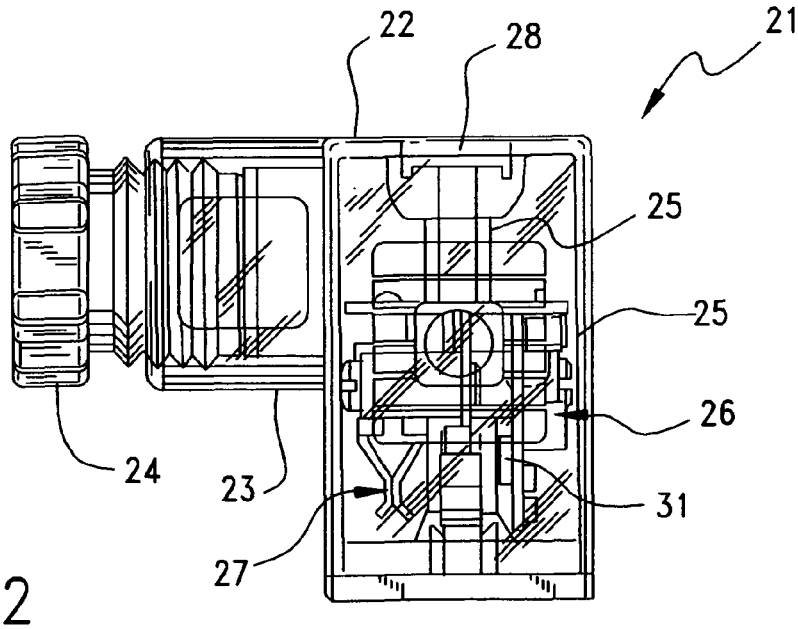
FIG. 2 is an elevation view of the illuminated electrical connector of FIG. 1.
Figure 3:
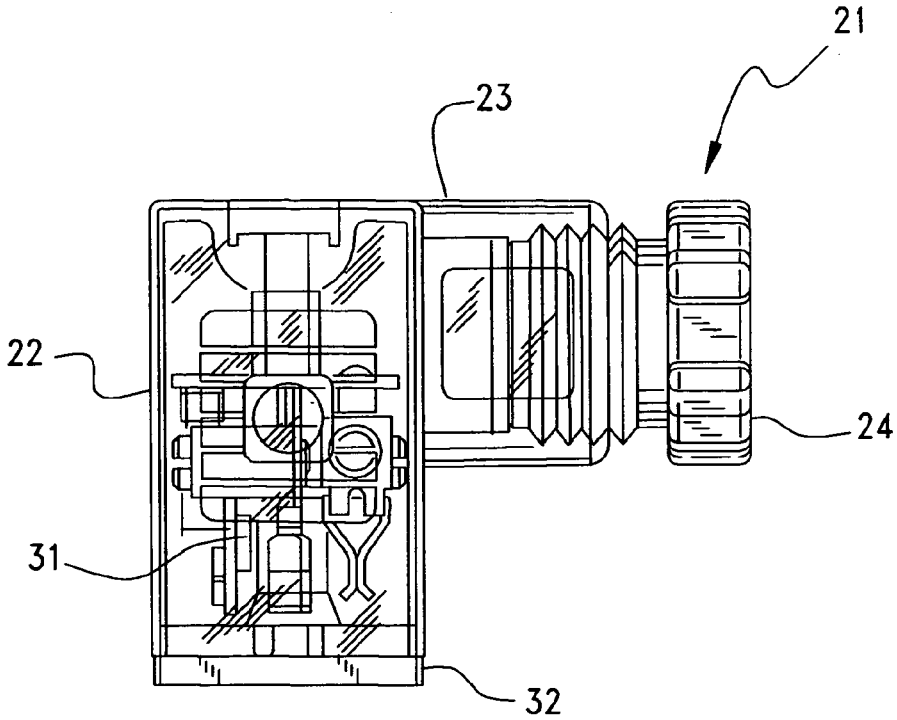
FIG. 3 is an elevation view of the connector of FIG. 1, taken from a side opposite to that of FIG. 2.
Figure 4:
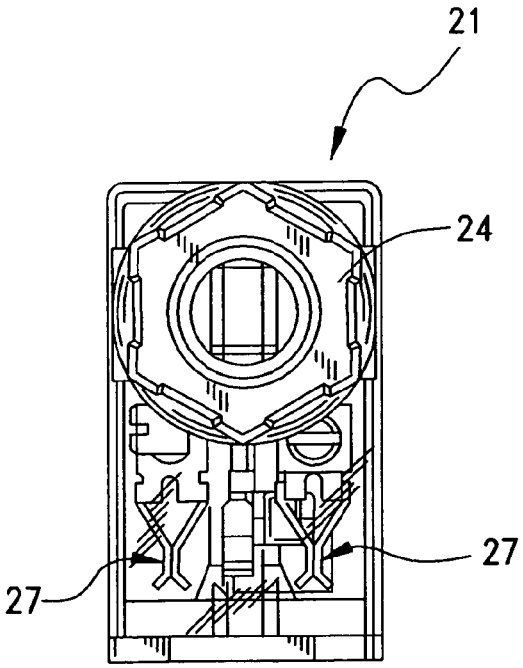
FIG. 4 is a front elevation view of the illuminated electrical connector of FIG. 1.
Figure 5:
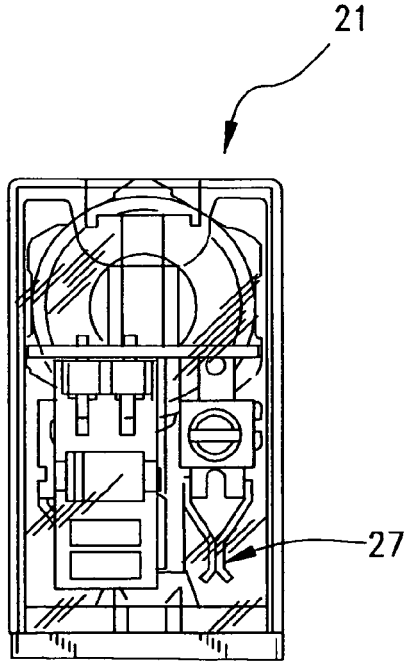
FIG. 5 is a rear elevation view of the illuminated electrical connector of FIG. 1.
Figure 6:
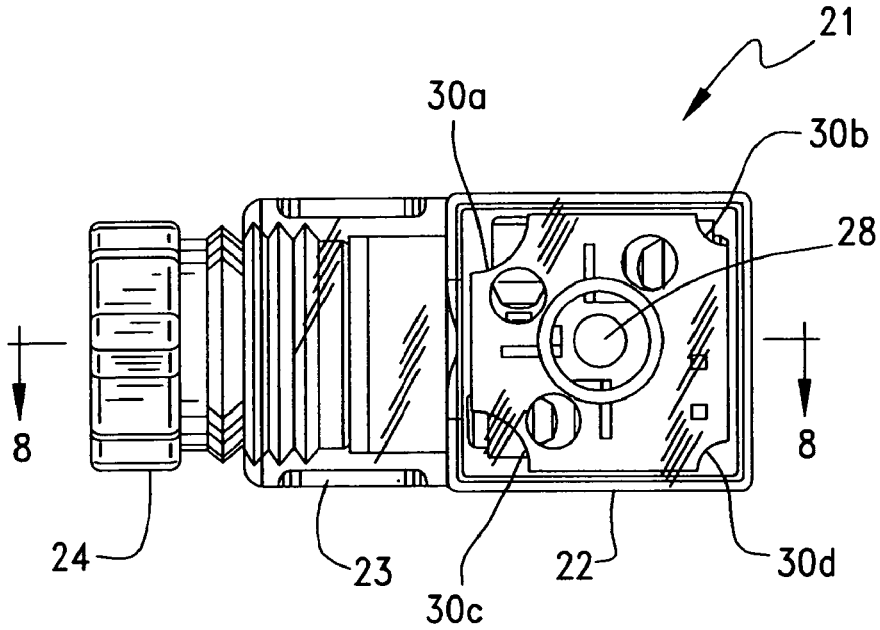
FIG. 6 is a top plan view of the illuminated electrical connector illustrated in FIG. 1.
Figure 7:
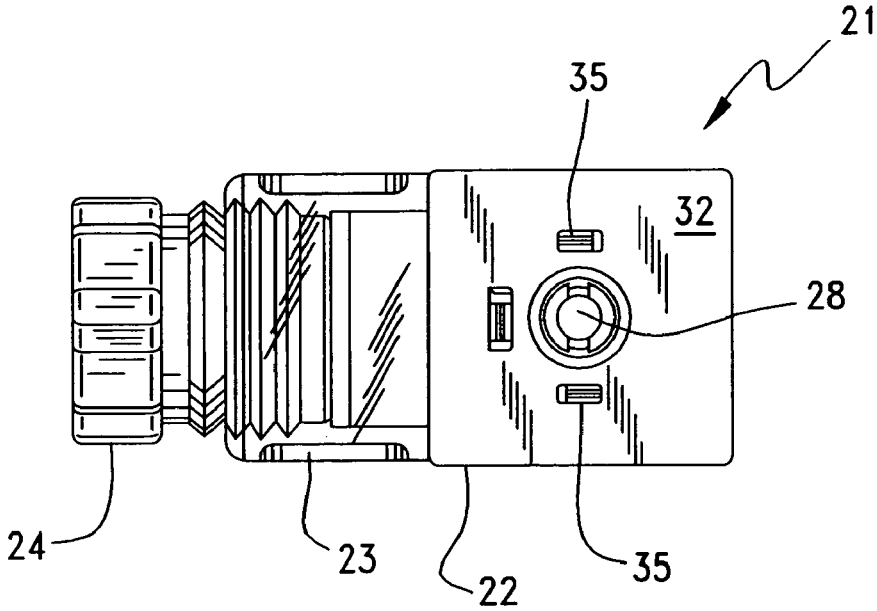
FIG. 7 is a bottom plan view of the illuminated electrical connector of FIG. 1.
Figure 8:
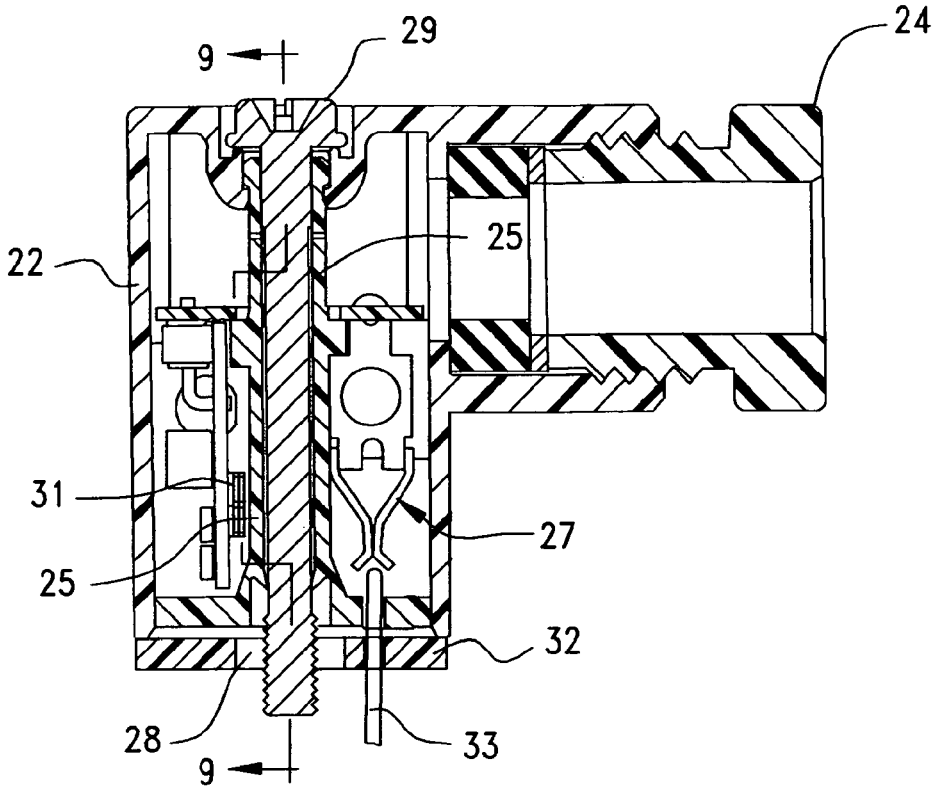
FIG. 8 is a cross-sectional view along the line 8-8 of FIG. 6.

An internal housing 25 is positioned within the external housing 22. The internal housing may be an essentially enclosed compartment or it may consist of multiple walls for supporting other components. In this illustrated embodiment, members of the internal housing support electrical components such as generally illustrated at 26 and connection components such as generally illustrated at 27. This illustrated embodiment also includes a passageway 28 for receiving an elongated attachment bolt (FIG. 8). The exact structure and location of the electronic components 26 and connector components 27 are indicative of the type of "high-tech" appearing elements that are rendered visible in accordance with the approach of the present invention. Internal housing components can be transparent or translucent, either throughout or at selected locations. Internal housing components can include openings to allow light transmission therethrough, such as the corner openings 30*a*, 30*b*, 30*c* and 30*d* illustrated in FIG. 6, for example.

Figure 9:
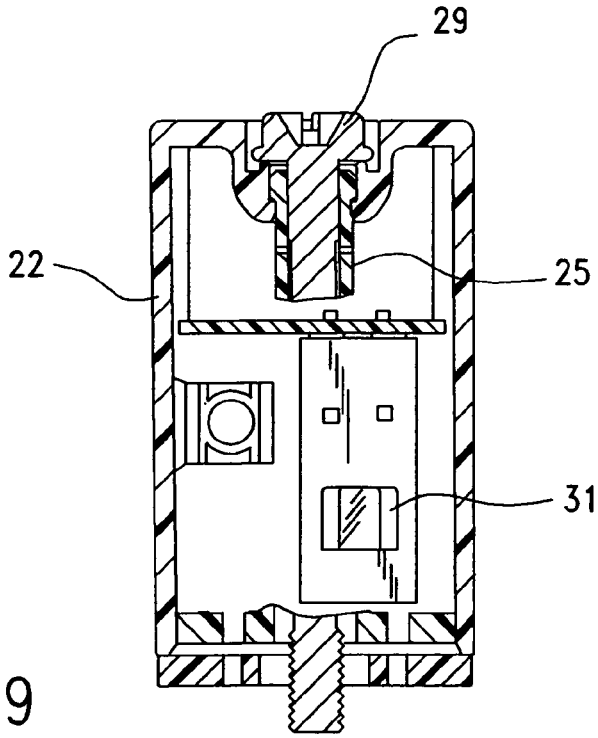
FIG. 9 is a cross-sectional view along the line 9-9 of FIG. 8.

The light source 31, for example a light-emitting diode (LED), is shown within the connector 21. As seen particularly in the embodiment of FIG. 8 and FIG. 9, this light source 31 is within the internal housing and the external housing of the illuminated electrical connector. When light emanates from the light source 31, it passes through the internal housing which in turn allows adequate light or lumens to pass through the external housing as well. Thus, the user of the illuminated electrical connector 21 views the connector from the outside with a substantial portion of the external walls of the connector being illuminated. This provides high visibility everywhere around the connection of the connector to other components including in the vicinity of the adapter 24 and the plug from which pin or pins 33 protrude. Also, this provides better visibility of the luminous signal along all exposed sides of the illuminated electrical connector 21.

In the illustrated example, the bottom wall 32 of the connector also can be transparent, and same typically provides an interface with a mating component such as one having a pin or pins 33 that enter the outer housing and inner housing for engagement with a connector component 27. In certain applications, two pins 33 are provided for mating engagement with two corresponding connector components 27. An opening 35 is shown for allowing access of the pin.

Each electronic component such as that illustrated generally at 26, and each connector component such as that illustrated generally at 27, is fully or at least partially within the internal housing or an internal housing wall or component. In many instances, these are secured to the internal housing. Each electronic component and connector component can be visible from the outside of the connector due to the transparent characteristic of the housings. This transparent characteristic can range from substantial transparency, such as that provided by a clear plastic component, or same can exhibit a degree of translucency, which typically renders a more muted appearance than when clear materials are used.

In some embodiments, one or more walls or portions of the housings, especially of the external housing, provide a muted illumination that substantially eliminates or reduces the lumens of light passing therethrough to a level that would cast so much illumination on a neighboring connector or device that such that the neighboring connector or device could be mistaken for a connector having the color of the illuminated connector from which the cast light originated. This type of muted illumination effect could be provided, for example, as a quality of external housing walls that are intended to be closely spaced from a wall of the neighboring connector or device, while other walls of the external housing can be more transparent so as to provide an aesthetically pleasing "high tech" effect by which internal components are visible through the outer housing and which cast significant light beams through the housing and out from the illuminated connector. Muted illumination of a wall or portion of a wall can be achieved by providing housing portions having greater diffusion properties when compared with a more transparent portion of the housing. Muted illumination can be provided by etched, uneven, abraided, colored or roughened surfaces.

Figure 11:
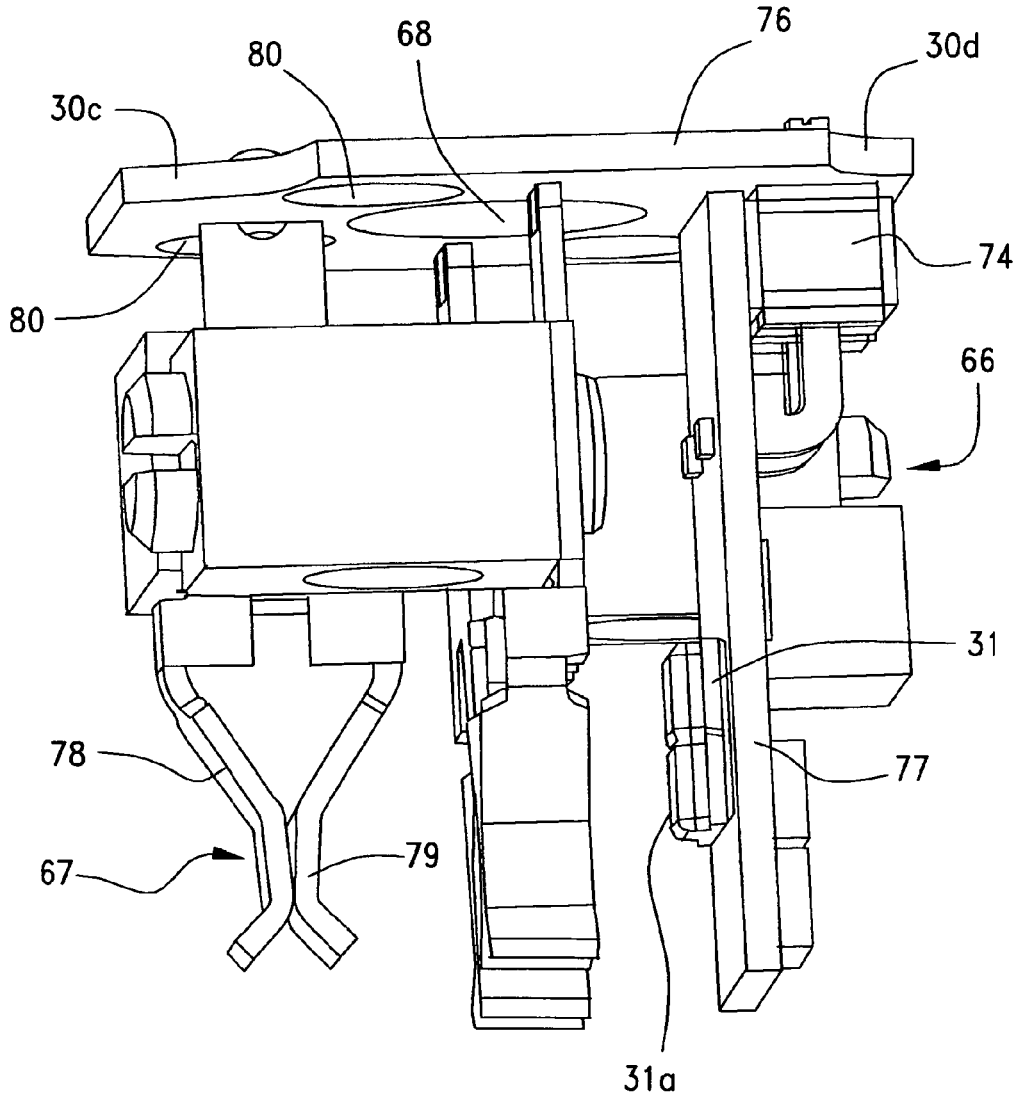
FIG. 11 is an enlarged perspective view of embodiments of electronic components and connector components of the type that can be included within or partially within the internal housing of an embodiment of the illuminated electrical connector.

In those instances when greater than one LED is provided, a variety of aesthetic effects can be achieved by incorporating light sources of different coloration. It will be appreciated that light sources such as LED units are available in a variety of colors, such as red, yellow, blue, green and clear, and LED units of different coloration could be used within the same illuminated electrical connector. For example, multiple LED units 31, 31*a* are illustrated in FIG. 11, and one could be of one color and another of a different color in order to achieve a desired aesthetic effect. In another embodiment, the illumination be provided by a clear or "white" light source such as an LED, in which case, the coloration of the connector can be provided by coloration of the housing or housings, typically of the external housing. Different effects can be provided by incorporating such coloration in only some walls and/or parts of walls of the housing or housings, whatever color is provided by the illumination source or sources.

In addition, different colorations can be used for different self-illuminating electrical connectors in order to provide a color-coding property for each connector of a plurality or array of the self-illuminating electrical connectors. For example, connectors having different properties could be designated by different colorations, as desired. Typical properties that can be designated by such a color-coding approach can include electrical properties or physical properties such as size, shape and/or style.

Elongated passageway 28 is sized and shaped to accommodate attachment bolt 29 that can be used, in some applications, to secure the connector in place. For example, for some types of DIN valve connectors used in certain pneumatic applications, the attachment bolt 29 can be provided to secure the connector in place in an especially secure manner.

Figure 10:
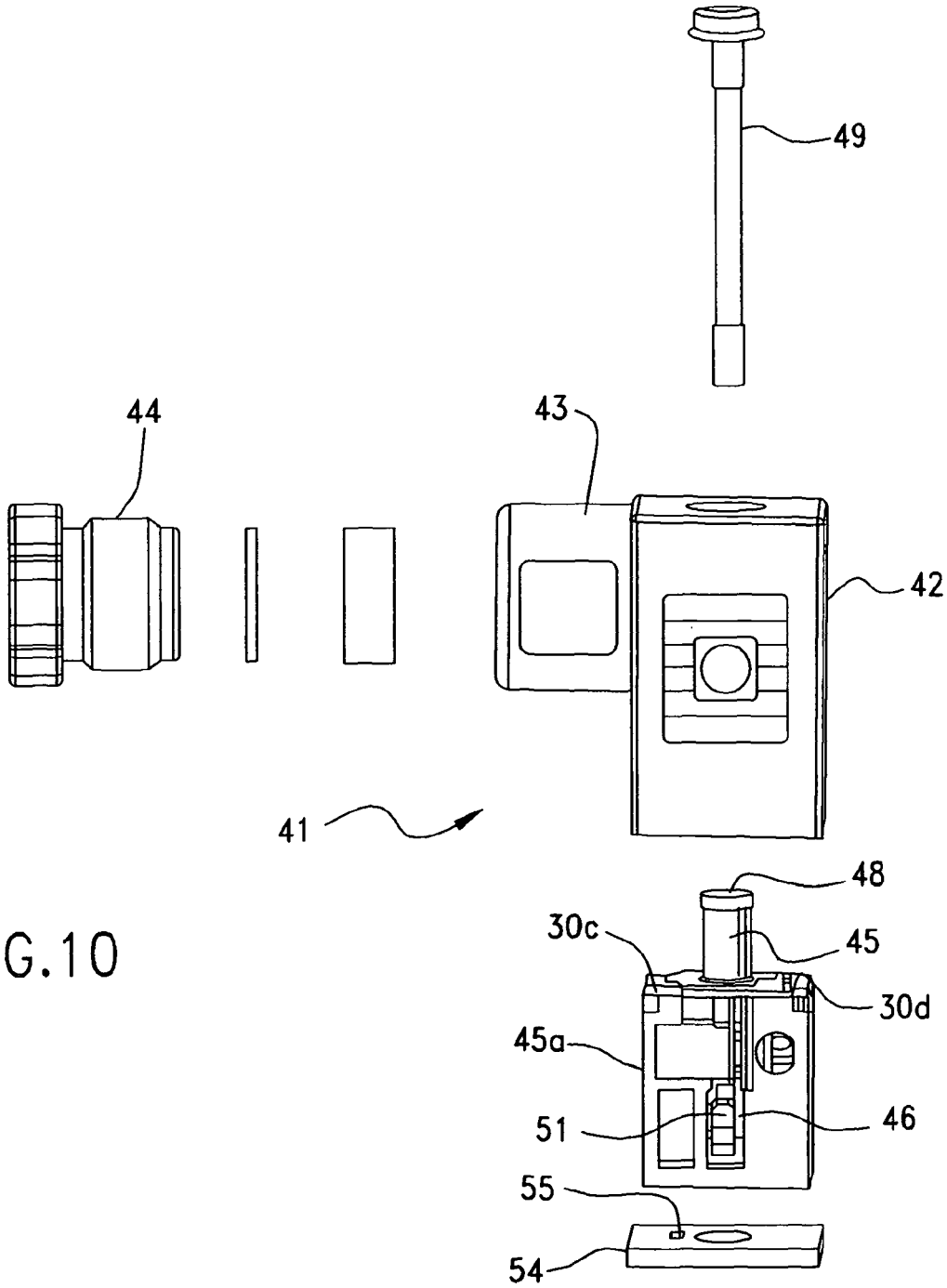
FIG. 10 is an exploded perspective view of an embodiment of an illuminated electrical connector including a mounting bolt.

Turning to the embodiment of FIG. 10, an illuminated electrical connector 41 is shown in exploded form. Included is an external housing 42 that has transparent, translucent or muted characteristics as discussed herein. Also shown is an internal housing components 45, 45*a* that also exhibits transparent characteristics, in this case, that of a clear plastic. Housing component 45 is shown as a cylinder having a passageway 48 sized to receive a bolt 49. Bolt 49 secures together the external housing 42, the internal housing component 45, and a base 54 which includes an opening 55 for receiving a mating component such as a pin therethrough. Also shown is a cylindrical branch 43 and an adapter 44 that is accommodated by the cylindrical branch 43 in a manner generally known in the art. Electronic components 46 are shown in a general way, as is elongated passageway 48, for receiving the bolt 49. A light source 51 also is shown.

FIG. 11 provides a detailed example of the type of electronic components and connector components that can be included within the illuminated electrical connector. This illustrates multiple light sources 31, 31*a*, which can be used instead of a single light source, as noted previously. Electronic components 66 and connector components 67 are generally shown in FIG. 11 Electronic components include a printed circuit board (PCB) header 74, a so-called horizontal PCB 76, and a so-called vertical PCB 77. An opening 68 is shown in the horizontal PCB for receiving a sleeve for accommodating and guiding a bolt or the like, such as the internal housing component 45 having the passageway 48 for receiving the bolt 49 that is shown in the FIG. 10 embodiment.

To reduce blockage of light from the light source by traditionally non-transparent or non-translucent components such as the PCB components, spacing features and/or light-transmission areas can be provided. Thus, for example in this embodiment of FIG. 11, at least the vertical PCB 77 is relatively narrow, thereby allowing light from the light source 31 and/or 31*a* to pass around the edges of the vertical PCB so as to enhance visibility at the exterior of the electrical connector of the light source emission originating within the connector. Additionally, areas allowing light transmission can be included where possible and desirable to further enhance visibility at the exterior of the electrical connector of the light source emission originating within the connector. Such areas include the corner cut-outs or openings 30*a*, 30*b*, 30*c* and 30*d* and/or possible open space that may be present between wires (not shown) and openings 80 to provide for passage of the wires through the horizontal PCB component 76 Again with reference to FIG. 11, light emitting from the light source is relatively unobstructed in a direction away from the vertical PCB component and in a direction away from the horizontal PCB component, thereby lessening any possible need for spacing features and/or light-transmitting areas discussed above with respect to the vertical PCB component and the horizontal PCB component, respectively.

It will be noted that the light source 31 and/or 31*a* is secured to one of the PCB components, the vertical one in this instance, in order to thereby provide energy to power the light source through an electrical circuit that includes members of the PCB and the PCB header. The PCBs and electronic components associated therewith provide the circuit operation that is needed for the particular illuminated electrical connector. It will be appreciated that these electronic components will vary depending upon the function and use application of the particular connector. For example, the circuitry illustrated in FIG. 11 is suitable for use in a DIN valve connector such as would be used in pneumatic, hydraulic or industrial control applications.

The illustrated connector component 67 includes opposing fingers 78, 79 that are biased in opposite directions so as to provide secure mating connection between fingers 78, 79 and a pin or other plug component with which the illuminated electrical connector is designed to mate. As previously noted, multiple finger pairs can be provided to accommodate respective pins.

It will be understood that there are numerous modifications of the illustrated embodiments described above which will be readily apparent to one skilled in the art, such as many variations and modifications to the size and shape of the housings and the connector details, including combinations of features disclosed herein that are individually disclosed or claimed, explicitly including additional combinations of such features, or alternatively other types of connectors suitable for illumination. Also, there are many possible variations in the materials and configurations which fall within the art to which this invention relates and are intended to be within the scope of the claims which follow. It is noted, as is conventional, that the use of a singular element in a claim is intended to cover one or more such element.

What is claimed is:

1. An illuminated electrical connector comprising:

an internal housing that supports electronic components, the internal housing having light-passing characteristics adequate to permit light to pass therethrough;

an external housing within which the internal housing is positioned, the external housing having transparent characteristics adequate to permit light emanating from the internal housing to pass therethrough;

a light source positioned internal of a wall of the internal housing such that light eminates external of the internal housing; and an electrical circuit for illuminating the light source;

whereby illumination from the light source is visible through at least 50% of the outer surface of the external housing; and a circuit component on the electrical circuit, the circuit component being at least partially within the internal housing, and wherein illumination from the light source results in the circuit component being visible from outside of the illuminated electrical connector;

wherein the circuit component includes one or more of a printed circuit board and other electronics;

wherein multiple printed circuit boards are positioned at least partially within the internal housing and are supported by a common printed circuit board header;

wherein one of the multiple printed circuit boards is a horizontal printed circuit board and another of the multiple printed circuit boards is a vertical printed circuit board, and the horizontal and vertical printed circuit boards are generally perpendicular to each other.

2. The illuminated connector according to claim 1, wherein the circuit component is positioned fully within the internal housing.

3. The illuminated connector according to claim 1, wherein the light source is a light-emitting diode (LED) unit.

4. The illuminated connector according to claim 3, wherein the LED is mounted to a printed circuit board component that is illuminated when the LED is illuminated and that is visible through the external housing.

5. The illuminated connector according to claim 3, wherein a plurality of LED members are provided as the light source, with a first LED being of a first color and a second LED being of a second color.

6. The illuminated connector according to claim 5, wherein the transparent characteristic of each of the internal housing and the external housing ranges from translucency to substantially full transparency.

7. The illuminated connector according to claim 6, further including at least one connection component at least partially within the internal housing, which connection component is accessible from the outside of the external housing and is visible through the external housing.

8. The illuminated connector according to claim 7, wherein illumination from the light source is visible through substantially the entirety of the external housing.

9. The illuminated connector according to claim 1, wherein the light source is positioned on the vertical printed circuit board and the vertical printed circuit board is narrower than the horizontal printed circuit board.

10. The illuminated connector according to claim 1, wherein at least one of the printed circuit boards includes at least one light-transmission area.

11. The illuminated connector according to claim 1, wherein said light source is of a selected first coloration and wherein another said light source is within the internal housing and is of a selected second coloration different from said selected first coloration.

12. The illuminated connector according to claim 11, wherein at least a portion of the external housing has an illumination muting effect that diffuses light eminating from the light source.

13. The illuminated connector according to claim 12, wherein the illumination muting effect includes coloration and wherein the light source provided white light, non-colored illumination.

14. A plurality of illuminated electrical connectors, wherein each connector comprises:

an internal housing component that supports electronic components, the internal housing having transparent characteristics adequate to permit light to pass therethrough, an external housing within which the internal housing component is positioned, the external housing having transparent characteristics adequate to permit light emanating through the internal housing component to pass therethrough, a light source internal of the internal housing component, and an electrical circuit for illuminating the light source, whereby illumination from the light source is visible through at least 50% of the outer surface of the external housing; and said light source of a first one of the illuminated electrical connectors is of a selected first coloration, while said light source of a second one of the illuminated electrical connectors is of a selected second coloration different from the selected first coloration; and a circuit component on the electrical circuit, the circuit component being at least partially within the internal housing, and wherein illumination from the light source results in the circuit component being visible from outside of the illuminated electrical connector;

wherein the circuit component includes one or more of a printed circuit board and other electronics;

wherein multiple printed circuit boards are positioned at least partially within the internal housing and are supported by a common printed circuit board header;

wherein one of the multiple printed circuit boards is a horizontal printed circuit board and another of the multiple printed circuit boards is a vertical printed circuit board, and the horizontal and vertical printed circuit boards are generally perpendicular to each other.

15. The plurality of connectors according to claim 14, wherein said selected colorations provide a color-coding property for each illuminated electrical connector to designate a difference in a property between the first connector and the second connector.

16. The plurality of connectors according to claim 15, wherein said property is selected from the group consisting of electrical, size, shape and style properties.

* * * * *